US005816470A

United States Patent [19]

Plato et al.

[11] Patent Number: 5,816,470

[45] Date of Patent: Oct. 6, 1998

[54] FASTENING DEVICE

[75] Inventors: Barry E. Plato, Bel Air; Richard M. Tankersley, White Marsh, both of Md.

[73] Assignee: Black & Decker Inc., Newark, Del.

[21] Appl. No.: 521,496

[22] Filed: Aug. 30, 1995

[51] Int. Cl.[6] ..... B25C 5/06

[52] U.S. Cl. ..... 227/132

[58] Field of Search ..... 227/132, 109, 227/120, 119, 134

[56] References Cited

U.S. PATENT DOCUMENTS

| | | | |
|---|---|---|---|
| 2,117,744 | 5/1938 | Polzer | 227/109 |
| 3,633,811 | 1/1972 | Ploen . | |
| 3,958,738 | 5/1976 | Tremblay | 227/109 |
| 4,556,161 | 12/1985 | Oide | 227/109 |
| 4,693,407 | 9/1987 | Buck et al. . | |
| 4,706,866 | 11/1987 | Ebihara . | |
| 5,337,945 | 8/1994 | Fehrle et al. . | |
| 5,407,118 | 4/1995 | Marks | 227/132 |
| 5,497,932 | 3/1996 | Brewer et al. | 227/132 |

FOREIGN PATENT DOCUMENTS 3126536 1/1983 Germany .

*Primary Examiner*—Scott A. Smith

*Attorney, Agent, or Firm*—Lerner, David, Littenberg, Krumholz & Mentlik

[57] ABSTRACT

A fastening device 100 includes a striker 260 for driving fasteners 129, such as staples 130 and nails 131, from the device and into a workpiece 396. The device 100 includes a fastener feed track 128 and a nosepiece 140 at the forward end of the track to guide the leading fasteners 129 into a discharge space 379 for ultimate driving of the lead fastener by the striker through the discharge space and from the device. The nosepiece 140 is formed with a groove or steep slope 402 adjacent the discharge space 379 which the nails 131 to move gradually laterally into the space for proper positioning of the nails as they are being driven through the space by the striker 260. The striker 260 is formed with a notch 406 in a portion of the surface of the striker which engages the fasteners 129 to drive the fasteners from the device 100. The notch 406 forms a nest which captures a head 392 of the nails 131 to prevent the nails from moving substantially laterally into the discharge space 379 as the nails are being driven from the device 100.

16 Claims, 14 Drawing Sheets

FASTENING DEVICE

BACKGROUND OF THE INVENTION

The present invention relates to a fastening device and, more particularly, to an improved fastener guide and driving mechanism for use in a manually operated fastening device.

Manually powered impact type stapling, tacking or nailing devices are well known. Such devices generally comprise a housing, an energy storage spring, a fastener feeding system, a movable operating handle to deflect the energy storage spring, a mechanism to rapidly disengage the handle from the deflected spring, and a sliding plunger linked to the spring to impact and drive a fastener from the housing. Examples of such impact type fastening machines are disclosed in Krantz U.S. Pat. No. 2,326,540, Abrams U.S. Pat. No. 2,671,215, Libert U.S. Pat. No. 2,769,174, Males et al U.S. Pat. No. 3,610,505, and Fealey U.S. Pat. No. 4,452,388.

In addition, another example of an impact type fastening device is disclosed in copending U.S. application Ser. No. 08/289,213, which was filed on Aug. 12, 1994, and is titled "Manually Operated Fastening Device" (hereinafter referred to as "the copending application"). This application and the copending application are each assigned to Black & Decker Inc. The disclosure of the copending application is incorporated herein by reference thereto.

The fastening device of the copending application includes an actuator mechanism having an operating lever for actuating a firing lever which engages a spring-biased striker to raise the striker against the bias of an actuator spring. The firing lever is shifted laterally at the top of its power stroke to disengage and release the striker for actuation by the actuator spring whereby the striker engages and drives a prepositioned fastener such as, for example, a staple into a workpiece. The firing lever is accurately reset for engagement with the striker when the actuator mechanism is returned to a rest position for the next power stroke of the fastening device.

The prepositioned staple is the lead staple of a plurality of serially-arranged staples each of which is generally formed in an inverted "U" shape having a pair of spaced legs joined at a common end by an intermediate section. The intermediate section of each of the plurality of staples rests on a guide track and is urged toward a lead position by a pusher. The forward end of the guide track is located between spaced arms of a nosepiece which also defines a confined space for engaging the outboard surfaces of each of the spaced legs thereof as the lead staple exits the track. The lead staple is retained in this position solely by the nosepiece for subsequent striking engagement by the striker to thereby facilitate the driving of the lead staple into the workpiece. The guide track and adjacent portions of the nosepiece define a pair of passages for receiving the pair of spaced legs of the staples as the staples are advanced toward the lead position. While the passages are dimensioned to allow the spaced legs of the staples to be moved forwardly therethrough, the width dimension constrains the legs of the staples from any lateral movement to insure that the lead staple arrives at the lead position in the proper orientation Consideration has been directed to using the fastening device to drive headed tacks or nails (both hereinafter referred to as "nails") into a workpiece. Nails of this type are formed with a head at one end of a stem with the other end of the stem being sharp or pointed for entry into the workpiece. Portions of the head extend at least from opposite sides of the stem to form a pair of spaced shoulders contiguous with the opposite sides of the stem. A plurality of the nails are arranged in serial fashion with one shoulder of each nail resting on the guide track on one side thereof. The nails are advanced into one of the passages formed by the track and the nosepiece whereby the other shoulder of the nail rests on the nosepiece. Eventually, the lead nail is urged from the forward end of the guide track and into the lead position with one shoulder continuing to rest on the nosepiece.

With the lead nail in this position, the striker is actuated to drive the nail into the workpiece. However, since the nail has no lateral boundary on the inboard side surface thereof, the nail has a tendency to become skewed laterally to the inboard side as the nail is being driven by the striker resulting in defective or incomplete assembly of the nail with the workpiece.

Thus, there is a need for a fastening device which will support nails in continuous alignment with a striker as the nail is being driven toward and into the workpiece.

There is also a need to provide structure for a fastening device which is capable of driving staples or nails while supporting the staples or nails in proper continuous alignment with the striker to insure efficient and effective driving thereof.

SUMMARY OF THE INVENTION

In view of the foregoing needs, it is an object of this invention to provide a fastening device which will maintain alignment of a nail during a period when the nail is being driven from the device.

Another object of this invention is to provide a versatile fastening device which is capable of efficiently and effectively driving staples or nails.

An additional object of this invention is to provide an impact fastening device having structure which insures the proper guidance of fasteners of different structure from the device.

With these and other objects in mind, this invention contemplates a fastening device for driving a fastener therefrom. The fastening device includes a housing, a fastener guide mounted in the housing for supporting selectively fasteners of either of at least two distinctly different configurations in position to be driven from the housing. A striker is mounted in the housing for engaging and driving the fastener from the housing with a spring biasingly coupled to the striker. A lever assembly is mounted on the housing and removably coupled to the striker for moving the striker to a "load" position against biasing action of the spring. A structure is located in the housing for decoupling the lever assembly from the striker when the striker is moved to the "load" position whereby the striker moves toward and drives the fastener from the housing, and the fastener guide is formed with structure which guides the fasteners of the at least two configurations from the housing in substantially their pre-driven configurations.

This invention further contemplates a fastening device having a housing and a striker mounted in the housing for engaging and driving a fastener from the housing. A spring is biasingly coupled to the striker. A lever assembly is mounted on the housing and removably coupled to the striker for moving the striker to a "load" position against biasing action of the spring. A structure is located on the housing for decoupling the lever assembly from the striker when the striker is moved to the "load" position. Guide structure is formed on the striker for engaging a selected portion of the fastener when the striker is decoupled from the lever assembly for guiding the fastener in a desired path as the fastener is being driven from the housing.

Other objects, features and advantages of the present invention will become more fully apparent from the following detailed description of the preferred embodiment, the appended claims and the accompanying drawings.

BRIEF DESCRIPTION OF THE DRAWINGS

The foregoing and other objects, aspects and advantages of the present invention will be better understood from the following detailed description of the preferred embodiments of the invention with reference to the drawings, in which.

DETAILED DESCRIPTION OF PREFERRED EMBODIMENT

Figure 1:
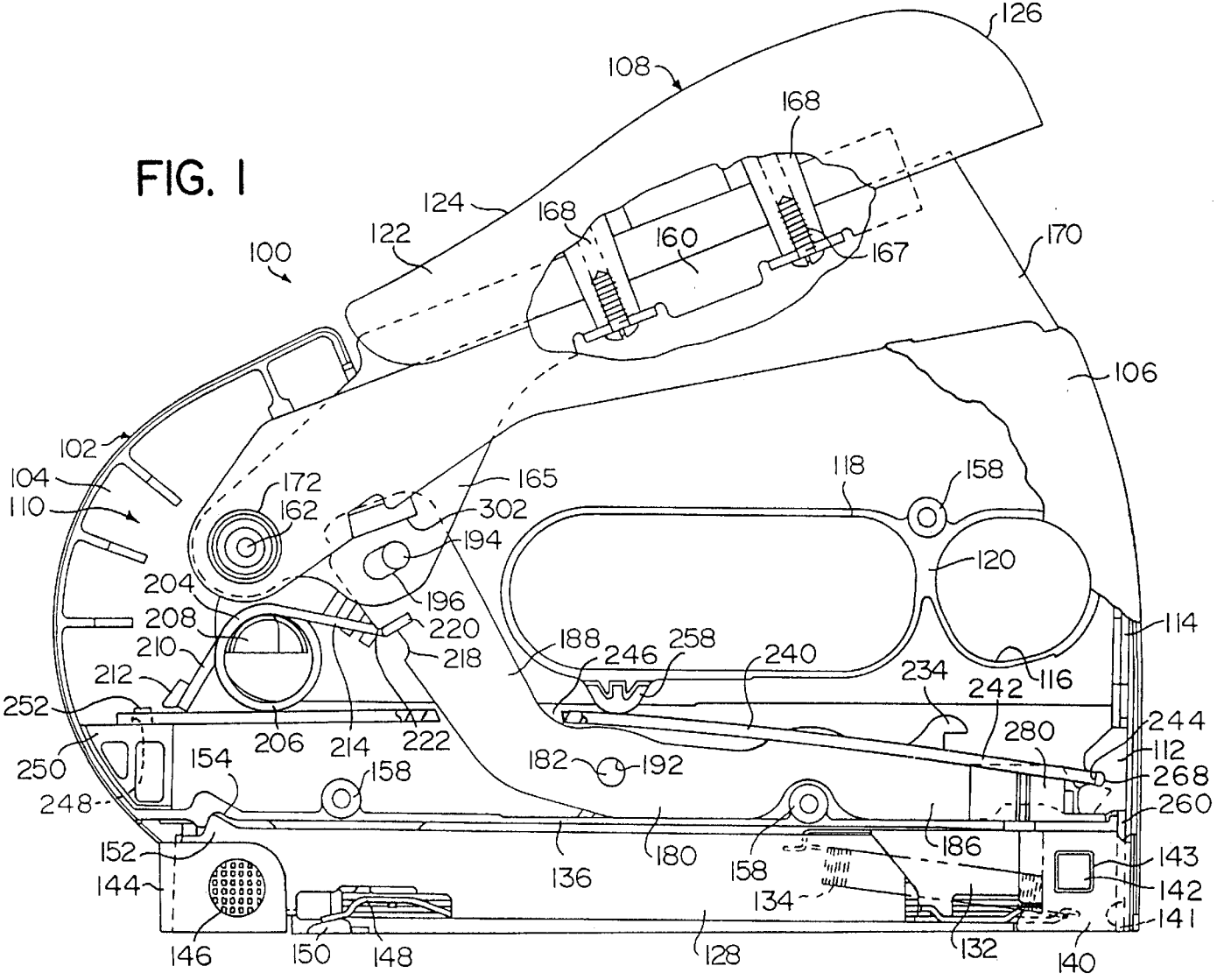
FIG. 1 is a partially cutaway side view of a fastening device constructed in accordance with the present invention with one of its housing sections removed to show various features within a housing.
Figure 2:
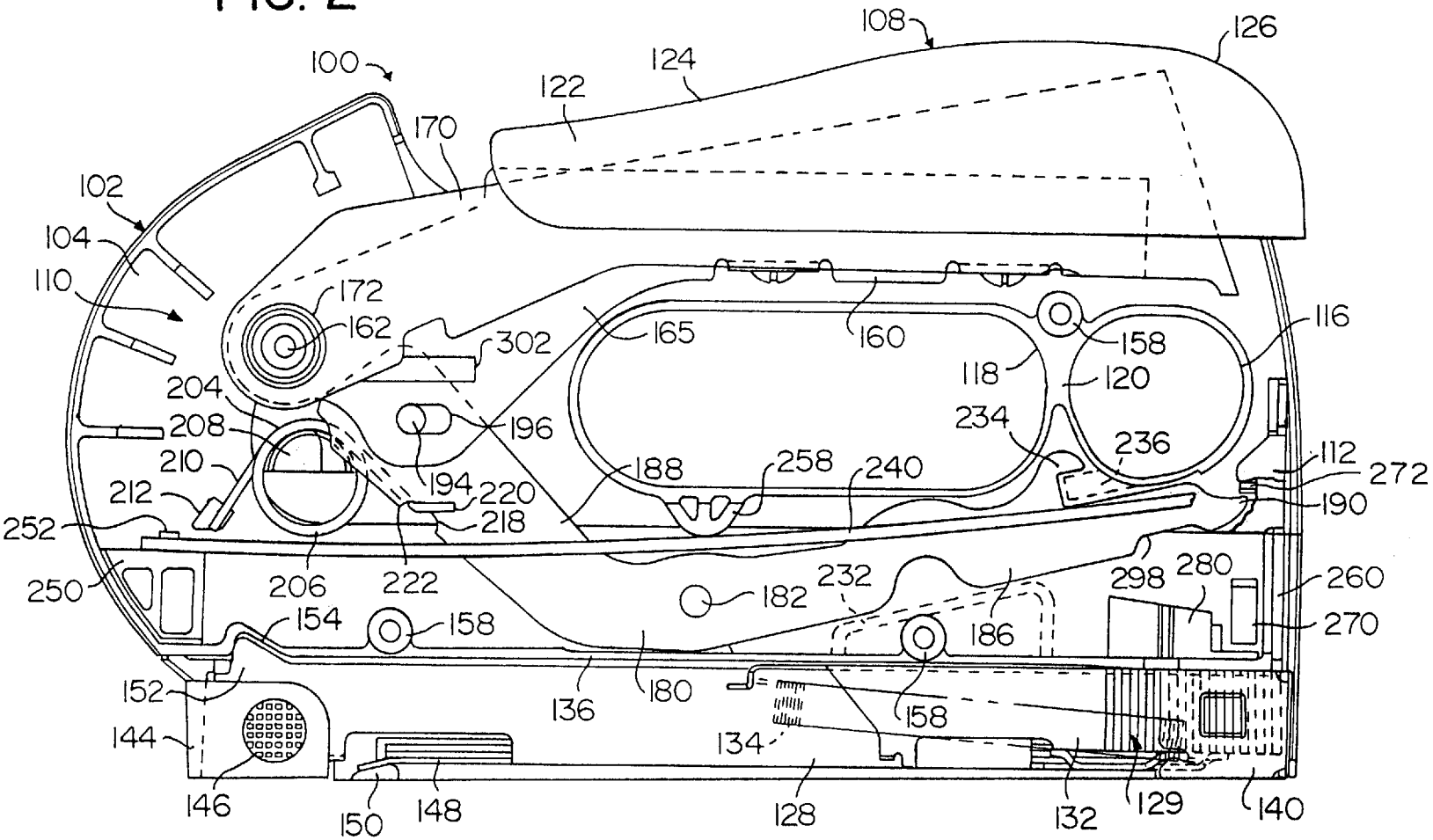
FIG. 2 is a partially cutaway side view of the device of FIG. 1 showing a fastener actuator mechanism having raised a striker to a "load" position in preparation for driving a fastener from the housing.

Referring to FIGS. 1 and 2, a fastening device 100 includes a two-part housing 102 which is split longitudinally and includes a pair of mating housing sections 104 and 106 containing the components of the device. An actuator handle assembly 108 is pivotally mounted toward the rear of the housing 102 and is inclined upwardly toward the front of the housing 102. The actuator handle assembly 108 forms part of an actuator mechanism 110 for actuating a fastener striker 112 which is mounted for reciprocation in a vertical track 114 (FIGS. 4 and 6) formed on the interior and adjacent to the front of each of the housing sections 104 and 106.

Each of the housing sections 104 and 106 consists of die cast metal and includes a front opening 116 for receiving the index finger of the hand of an operator gripping the device 100. An elongated opening 118 is provided in each of the housing sections 104 and 106 for receiving the remaining fingers of the hand of the operator. A finger stop 120 separates the openings 116 and 118 in each of the handle sections 104 and 106 and provides a surface for the middle finger to support the device 100 when it is held in a vertical position. The actuator handle assembly 108 has a cover-shaped handle 122 formed of molded plastic material which has a gradually curved upper surface 124 and a rounded front end 126 to accommodate the thumb of the operator and facilitate the actuation the device 100.

Figure 3:
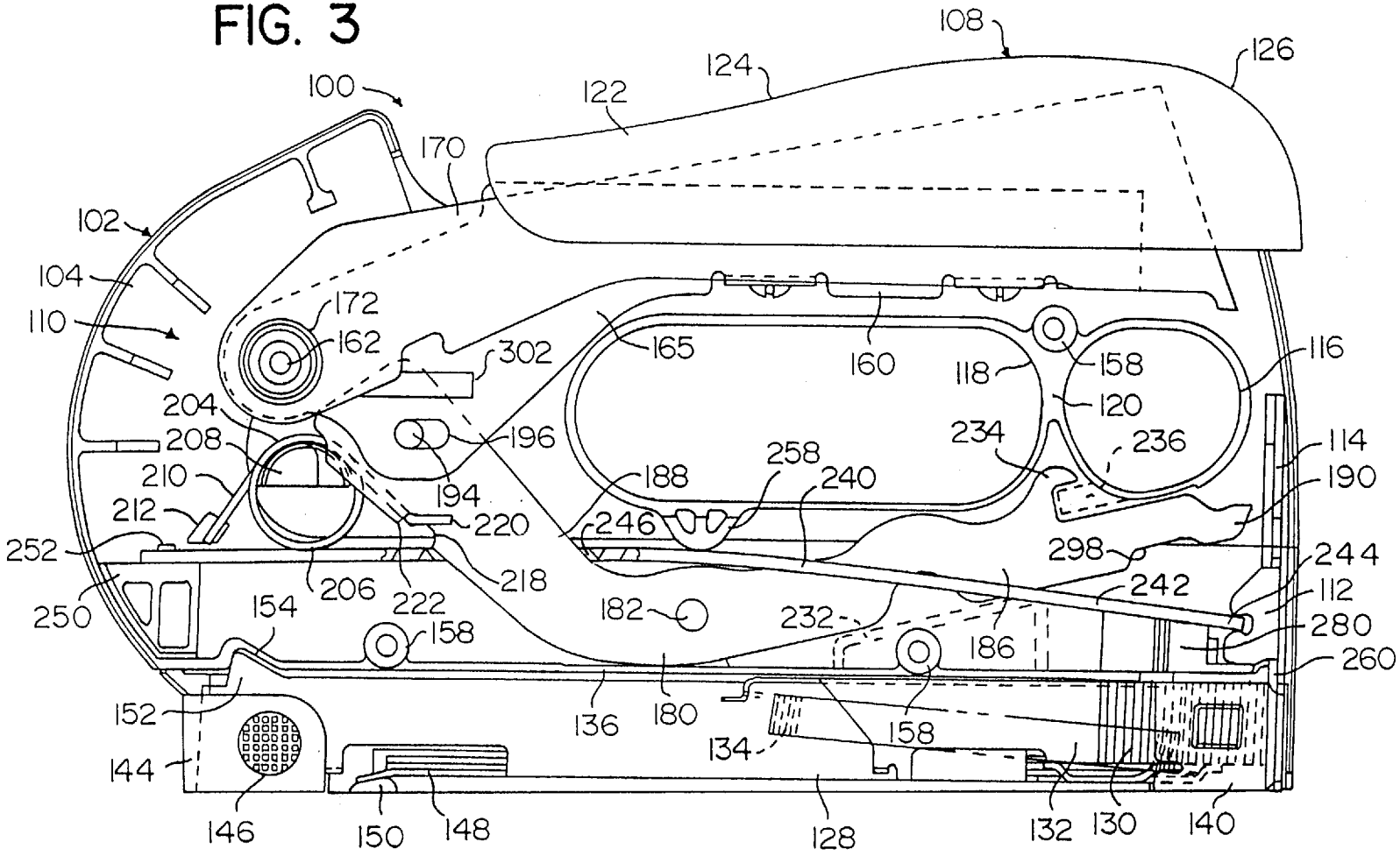
FIG. 3 is a partially cutaway side view of the device of FIG. 1 showing the fastener actuator mechanism at the end of its power stroke after driving the fastener from the housing.
Figures 4, 5:
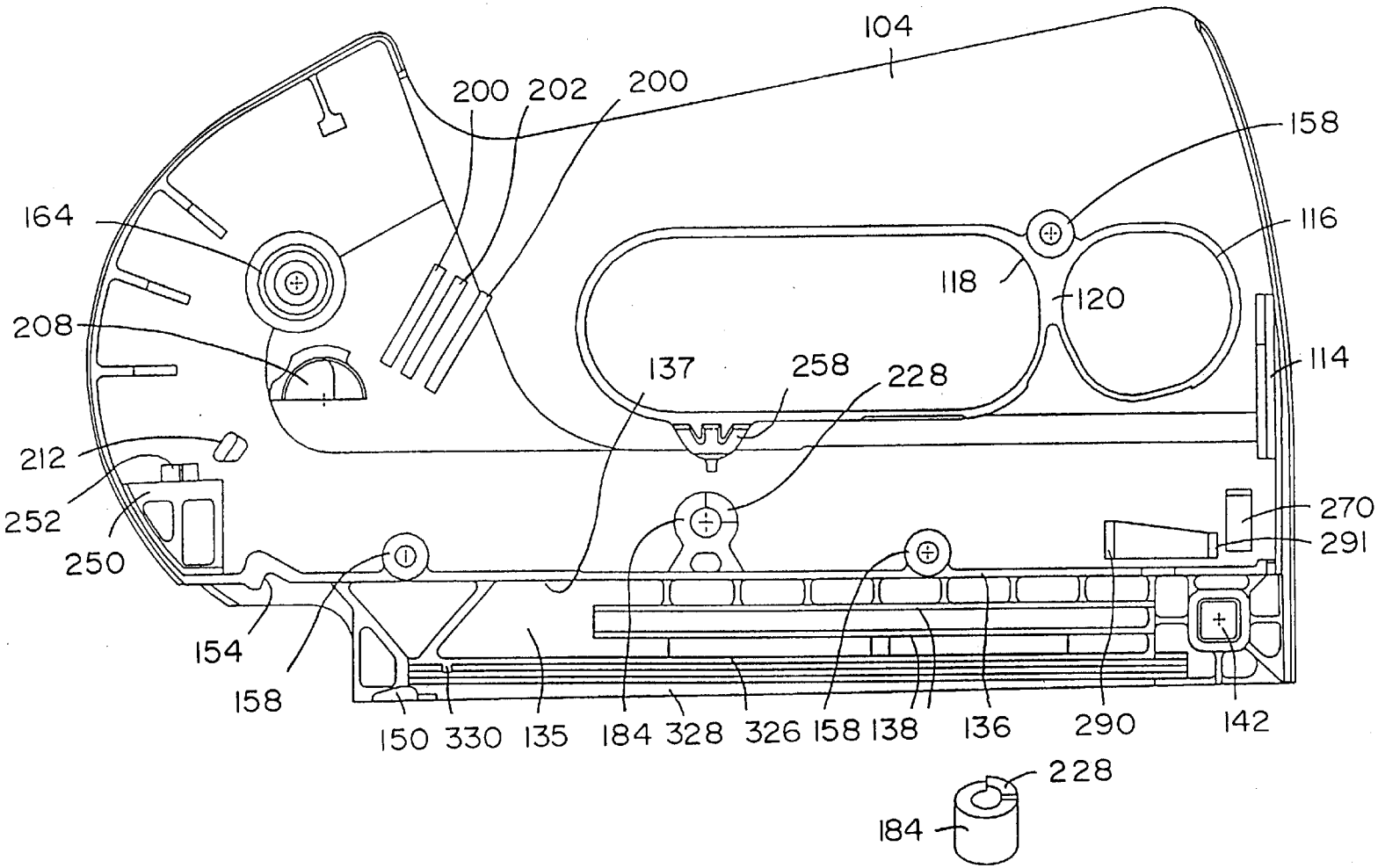
FIG. 4 is a side view of one of the housing sections of the fastening device of FIG. 1.
FIG. 5 is a fragmentary perspective view of a lever support boss on the interior of the housing section of FIG. 4.
Figure 6:
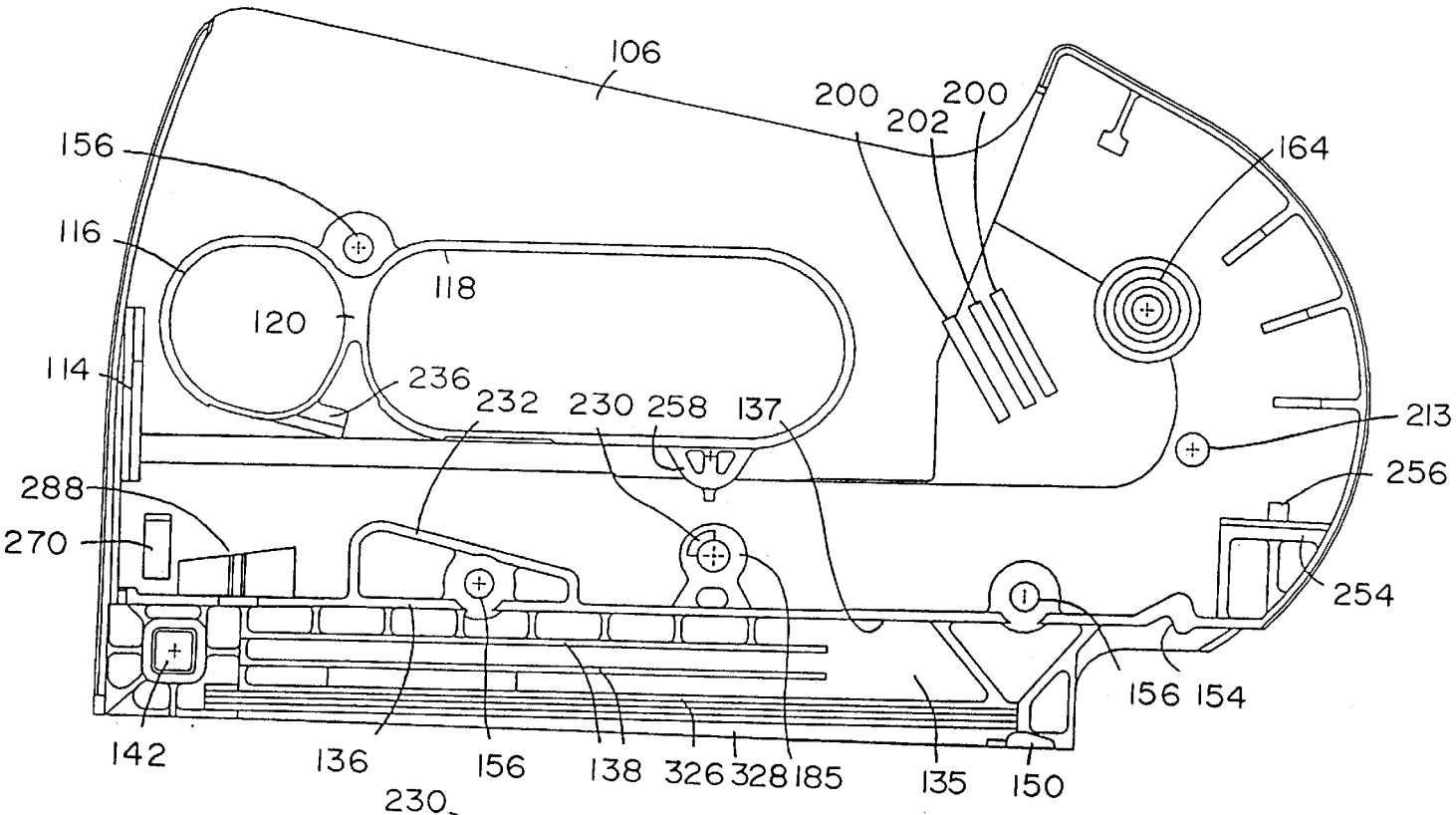
FIG. 6 is a side view of the other housing section of the fastening device.

At the bottom of the housing 102, a fastener guide track 128 is mounted for receiving and guiding a plurality of fasteners 129 (FIG. 2) such as, for example, staples 130 (FIG. 3) or nails 131 (FIG. 21) toward the front of the housing 102. A fastener pusher 132 is slidably mounted on the guide track 128 and is pulled forwardly by a tension spring 134 to urge the fasteners 129 toward the front of the housing 102. As shown in FIGS. 4 and 6, each of the housing sections 104 and 106 includes an elongated rectangular side wall 135 and a longitudinal wall 136 extending along substantially the entire length of the housing 102 which provide a channel 137 at the bottom of the device 100 for receiving the guide track 128 and the fasteners 129. A pair of elongated ribs 138 is formed on each of the side walls 135 below the longitudinal wall 136 on each of the housing sections 104 and 106 to guide the fasteners 129 along the guide track 128 toward the striker 112.

A U-shaped nosepiece 140 (FIGS. 1, 14, 15 and 16), having a center wall 370 joined to a pair of spaced sidewalls 372 and 374, is mounted on opposed rectangular bosses 142 (FIGS. 4 and 6) adjacent to the front of the housings sections 104 and 106 for guiding the fasteners 129 into alignment with the striker 112. When the striker 112 is raised, the frontmost fastener 130 is urged into a discharge space 379 against an inner surface 141 of the center wall 370 of the nosepiece 140 by the pusher 132 and is aligned with the striker 112. A pair of rectangular openings 143 is formed in the pair of spaced side walls 372 and 374 of the nosepiece 140 for receiving the rectangular bosses 142 on the housing sections 104 and 106.

A U-shaped track pull member 144 (FIGS. 1, 25, 26 and 27) is connected to the rear end of the guide track 128 and provided with gripping pads 146 on its opposite sides to enable the operator to slide the guide track 128 rearwardly to load the fasteners 129 into the channel 137 at the bottom of the device 100. Normally, the guide track 128 is retained in the housing 102 by a leaf spring 148 extending from the bottom of the guide track 128 and engaging a ledge 150 formed at the bottom of each of the side walls 135 to urge a pair of lugs 152 formed at the top of the guide track 128 into a pair of notches 154 formed in the longitudinal walls 136 of the housing sections 104 and 106.

The housing sections 104 and 106 are assembled by a plurality of screws (not shown) which are inserted into a plurality of screw holes 156 (FIG. 6) formed in the housing section 106 and are threaded into a corresponding set of screw-receiving bosses 158 (FIG. 4) formed on the housing section 104. Referring to FIG. 1, the fastener actuator mechanism 110 includes an upper operating lever 160 which is pivotally mounted on a pivot pin 162 located toward the rear of the housing 102. The pivot pin 162 is received in a pair of opposed cylindrical bosses 164 (FIGS. 4 and 6) formed on the interior of the housing sections 104 and 106. The operating lever 160 comprises a flat metal plate which is bent into a channel-shaped configuration to provide a top wall and a pair of side walls including a pair of rearwardly extending depending flanges 165 (one shown). The flanges 165 have a pair of circular holes (not shown) formed toward the rear which receive the pivot pin 162 to support the operating lever 160 for pivotal movement relative to the housing 102. As shown in FIG. 1, the operating lever 160 is attached to the handle 122 by a pair of screws 167 which are threaded into a pair of hollow cylindrical stem 168 extending downward from the handle 122. The screws 167 are inserted through a pair of flanges (not shown) of the operating lever 160.

As shown in FIG. 1, an elongated channel-shaped sleeve 170 is loosely mounted underneath the handle 122 and overlaps the operating lever 160. The sleeve 170 has a pair of circular holes (not shown) formed toward the rear which receive the cylindrical bosses 164 on the housing sections 104 and 106 to support the sleeve 170 for pivotal movement relative to the housing 102. The sleeve 170 protects the components of the actuator mechanism 110 located inside the housing 102 and prevents the fingers of the operator from being pinched between the housing 102 and the operating lever 160 when the device 100 is actuated.

The actuator mechanism 110 includes a lower firing lever 180 which is pivotally mounted on a pivot pin 182 located toward the bottom of the housing 102 approximately midway between the front and rear of the housing 102. The pivot pin 182 is mounted in a pair of cylindrical bosses 184 and 185 (FIGS. 4 and 6) formed on the interior of the housing sections 104 and 106, respectively. The lower firing lever 180 consists of a flat metal plate including an elongated front portion 186 extending toward the striker 112 and having an upwardly angled rear portion 188 which is overlapped by the pair of depending flanges 165 formed on the opposite sides of the upper operating lever 160. The firing lever 160 has a front tip 190 (FIGS. 2 and 3) for raising the striker 112 when the actuator mechanism 110 is operated.

Referring to FIG. 1, the lower firing lever 180 includes a pivot hole 192 having a slightly larger diameter than the pivot pin 182 to provide a loose pivot connection which supports the lower firing lever 180 for pivotal movement about the axis of the pivot pin 182 and allows the lower firing lever 180 to rock sideways with a wobble-like motion about the pivot pin 182 relative to the housing sections 104 and 106. The rocking motion of the lower firing lever 180 enables the front portion 186 and the front tip 190 of the firing lever 180 to be shifted laterally relative to the striker 112.

As shown in FIG. 1, the upper operating lever 160 is coupled to the lower firing lever 180 by a roller pin 194 which is slidably and rotatably received in a pair of elongated kidney-shaped slots 196 formed in the depending flanges 165. The roller pin 194 is also slidably-and rotatably received in an elongated kidney-shaped slot (not shown) formed near the upper end of the rear portion 188 of the firing lever 180. The roller pin 194 together with the slot 196 and the kidney-shaped slots of flanges 165 provide a pin and slot connection between the operating lever 160 and the firing lever 180. The opposite ends of the roller pin 194 are slidably received between a pair of spaced parallel guide rails 200 (FIGS. 4 and 6) which project inwardly from the housing sections 104 and 106. The movement of the roller pin 194 relative to the housing 102 is restricted by the guide rails 200 and by an elongated rib 202 of reduced height located between the guide rails 200 on each of the housing sections 104 and 106.

Referring to FIG. 1, the actuator mechanism 110 includes a return spring 204 for normally biasing the lower firing lever 180 toward a rest position. The return spring 204 is embodied as a torsion coil spring including a plurality of coils 206 which encircle a semi-cylindrical post 208 formed on the housing section 104. The return spring has a rear arm 210 engaged with a tab 212 on the housing section 104. A post 213 (FIG. 6) on the interior of the housing section 106 is located to the side of the rear spring arm 210 to prevent the rear spring arm 210 from shifting laterally and being disengaged from the tab 212. The return spring 204 has a front arm 214 bent sideways to provide an offset portion which extends across an elongated notch 218 formed at the rear of the firing lever 180. The spring 204 is maintained in torsion by the spring arms 210 and 214 which are engaged with the tab 212 and notch 218, respectively, to bias the firing lever 180 clockwise about the pivot pin 182 toward the rest toward. The torsion of the spring 204 is transmitted by the roller pin 194 to the upper operating lever 160 to bias the operating lever 160 counterclockwise about the pivot pin 162 and to urge the handle assembly 108 toward its upwardly inclined rest position.

As shown in FIG. 1, the front arm 214 of the return spring 204 has a laterally slanted front tip 220 extending partially across the rear portion 188 of the firing lever 180 adjacent to the notch 218. The firing lever 180 has a corner 222 adjacent to the elongated notch 218 which overlaps the front arm 214 of the return spring 204. The front spring arm 214 exerts a lateral biasing force at the corner 222 on the rear portion 188 of the firing lever 180 to urge the front portion 186 of the firing lever laterally toward the housing section 104. However, as explained below, the lateral biasing force of the torsion spring arm 214 on the rear portion 188 of the firing lever 180 is counteracted by another force applied by a reset mechanism to the front portion 186 of the firing lever 180 to locate the firing lever 180 in its rest position and to maintain its front tip 190 in a desired alignment with the striker 112.

Figure 7:
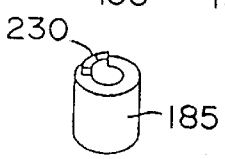
FIG. 7 is a fragmentary perspective of a lever support boss formed on the interior of the housing section of FIG. 6.

As shown in FIGS. 4 and 5, the cylindrical boss 184 on the housing section 104 has a raised arcuate surface or pad 228 located on its circular face in the quadrant extending upward and forward relative to the housing section 104. Similarly, as shown in FIGS. 6 and 7, the cylindrical boss 185 on the interior of the housing section 106 has a raised arcuate surface or pad 230 formed on its circular face in the quadrant extending upward and forward relative to the housing section 106. The arcuate pad 230 on the boss 185 is narrower than the arcuate pad 228 on the boss 184. The arcuate pads 228 and 230 serve as spacers which locate the lower firing lever 180 away from the circular faces of the cylindrical bosses 184 and 185 to facilitate the lateral rocking motion of the lower firing lever 180 about the pivot pin 182. An inclined guide rib 232 (FIG. 6) is formed on the interior of the housing section 106 to limit the lateral rocking motion of the front portion 186 of the firing lever 180.

As shown in FIG. 1, an upwardly extending hook-like projection 234 is formed on the front portion 186 of the lower firing lever 180. The housing section 106 is provided with a ledge 236 (FIG. 6) which is located above and forward of the guide rib 232. Initially, when the lower firing lever 180 is pivoted to raise the striker 112, the front portion 186 of the lower firing lever 180 is slidably engaged with the adjacent face of the guide rib 232 and the hook-like projection 234 is slidably engaged with the adjacent face of the ledge 236. The guide rib 232 and the ledge 236 prevent the front portion of the lower firing lever 180 from being shifted laterally toward the housing section 106 until the front portion of the lower firing lever 180 is pivoted above the guide rib 232 and the hook-like projection 232 is moved above the ledge 236.

Referring to FIG. 1, the actuator mechanism 110 includes an actuator or power spring 240 in the form of an elongated leaf spring which extends along substantially the entire length of the housing 102 and is coupled at its front end to the striker 112. The power spring 240 comprises a flat elongated metal leaf spring which has a wide mid-section and tapers to a more narrow width toward the front and the back. The power spring 240 is bifurcated at its front end to provide a pair of elongated, tapered spring arms 242 (one shown) which are spaced apart by a V-shaped slot to receive the front portion 186 of the lower firing lever 180 therebetween.

A pair of notches 244 (one shown) is provided at the tips of the spring arms 242 for engagement with the striker 112. An elongated triangular slot 246 extends toward the rear end of the power spring 240 to receive the rear portion 188 of the firing lever 180. At the rear end of the power spring 240, an elongated lateral notch 248 extends to one side of the power spring 240. The rear end of the power spring 240 rests on a ledge 250 (FIG. 4) formed on the interior of the housing section 104. An elongated flange 252 is formed on the ledge 250 and is received in the lateral notch 248 to locate the power spring 240 longitudinally relative to the housing 102. Similarly, the rear end of the power spring 240 rests on a ledge 254 (FIG. 6) formed toward the rear of the housing section 106. A lug 256 formed on the ledge 254 engages the side of the power spring 240 to retain the lateral flange 252 engaged in the lateral notch 248.

As shown in FIG. 1, the power spring 240 is normally curved in a concave downward configuration to bias the striker 112 toward the bottom of the stapler housing 102. A rounded boss 258 is formed on each of the housing sections 104 and 106 approximately midway between the front and rear of the housing 102. The rounded bosses 258 engage the top of the power spring 240 on the opposite sides of its mid-section 241. When the striker 112 is raised upward by operation of the actuator mechanism 110, the power spring 240 is flexed about the rounded bosses 258 into a concave upward configuration (FIG. 2) to load the power spring 240 for-actuating the striker 112. When the striker 112 is released, the power spring 240 returns to its concave downward configuration (FIG. 3) to actuate the striker 112 and drive the frontmost fastener 129 downward from the housing 102.

Figure 8:
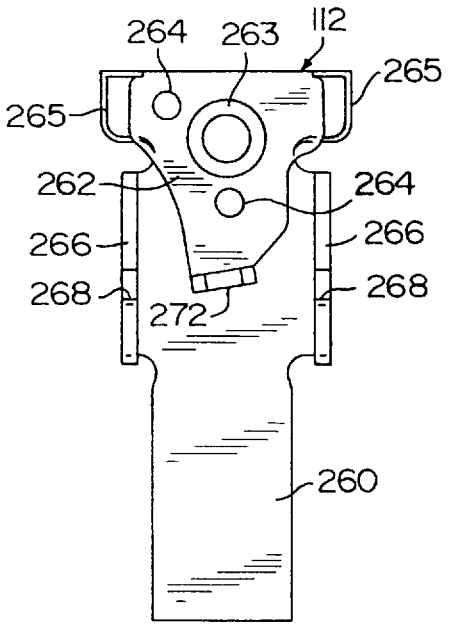
FIG. 8 is a rear view of a striker which forms part of the fastener actuator mechanism.
Figure 9:
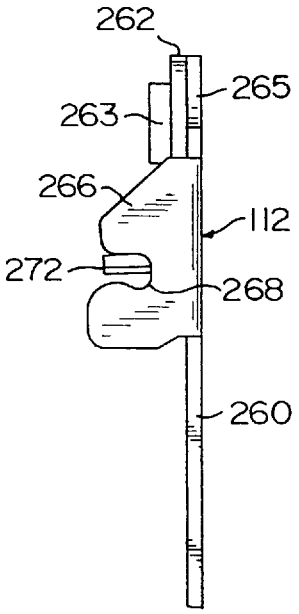
FIG. 9 is a side view showing the striker of FIG. 8.
Figure 10:
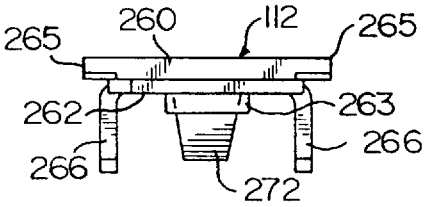
FIG. 10 is a top view showing the striker of FIG. 8.
Figure 43:
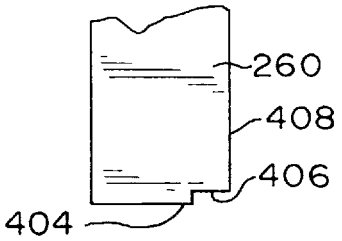
FIG. 43 is a front view showing the striker blade modified as illustrated in FIGS. 36, 37 and 38 in accordance with certain principles of the invention.

Referring to FIGS. 8, 9 and 10, the striker 112 is a two-part metal element consisting of a striker blade 260 for driving the fasteners 129 from the guide track 128 and a striker tongue 262 for engaging the front tip 190 of the lower firing lever 180. The striker blade 260 and the striker tongue 262 are joined together by conventional fastening techniques, e.g., by spot welding or a tox-point joint 263.

A pair of dimples 264 is formed on the striker tongue 262 and received in corresponding recesses (not shown) formed on the striker blade 260 to align the tongue 262 with the blade 260. The striker blade 260 has a pair of ears 265 extending outwardly from its opposite sides which are slidably received in the vertical tracks 114 at the front of the housing sections 104 and 106. The striker blade 260 has a pair of rearwardly extending flanges 266 formed on its opposite sides and provided with slots 268 in which the notches 244 at the front of the power spring arms 242 are engaged. A pair of guide flanges 270 (FIGS. 4 and 6) is formed toward the front of the housing sections 104 and 106 for engaging the sides of the spring arms 242 to retain the notches 244 of the spring arms 242 engaged in the slots 268 of the striker flanges 266. Normally, the frontmost fastener 129 is urged by the pusher 132 into engagement with the rear face of the striker blade 260. When the striker 112 is raised (FIG. 1), the frontmost fastener 129 is urged against the inner surface 141 center wall 370 of the nosepiece 140 by the pusher 132 and is aligned underneath the striker blade 260 within discharge space 379.

As shown in FIG. 8, the striker tongue 262 has a rearwardly extending tab 272 which is canted sideways at a predetermined angle, e.g., 8.5°, with the higher edge of the tab 272 facing toward the housing section 106 provided with the guide rib 232. The front tip 190 of the firing lever 180 has an upper surface which is canted at the same predetermined angle, e.g., 8.5°, to slidably engage the underside of the canted tab 272.

The front tip 190 is positioned underneath the canted tab 272 of the striker 112 when the staple actuator mechanism 110 is in its rest position. When the front tip 190 of the firing lever 180 is raised, the canted surface on the tip 190 is slidably engaged with the underside of the canted tab 272 on the striker 112. The engagement of the canted surface on tip 190 with the canted tab 272 urges the front tip 190 of the firing lever 180 sideways along the underside of the canted tab 272 toward the housing section 106. However, the front portion 186 of the firing lever 180 engages the adjacent face of the guide rib 232 on the housing section 106 and the hook 234 on the firing lever 180 engages the adjacent face of the ledge 236 on the housing section 106 to prevent the front tip 190 of the firing lever 180 from being cammed out of engagement with the canted tab 272.

With the actuator mechanism 110 in its rest position (FIG. 1), the front end of the power spring 240 rests on a molded plastic support member 280 mounted toward the front of the housing sections 104 and 106 adjacent to the striker 112. Preferably, the support member 280 consists of a thermoplastic elastomer, e.g., Hytrel, a trademark of the Dupont Company, which has a natural lubricity. The support member 280 limits the downward travel of the front end of the power spring 240 and the striker 112 and absorbs the impact of the power spring 240 when the device 100 is actuated.

The support member 280 is a block-like element having a pair of spaced parallel side walls which are slanted downwardly toward the front and joined together by a thin flat base. The thicker side wall has a vertical notch for receiving a vertical rib 288 (FIG. 6) formed on the interior of the housing section 106. The thinner side wall is cut away at the rear to provide a recess which receives a vertical rib 290 (FIG. 4) formed on the interior of the housing section 104. Another vertical rib 291 is formed on the housing section 104 to engage the front end of the side wall of the support member 280.

The support member 280 has a resilient finger not shown which slants downwardly and inwardly from the rear of the thinner side wall into the space between the side walls. The resilient finger has a generally T-shaped cross section which is partially cutaway to provide a slanted rear edge. The resilient finger has a front edge oriented perpendicularly inward from the side wall of the support member 280.

The resilient finger functions as a reset mechanism for shifting the lower firing lever 180 laterally into its rest position and to locate the front tip 190 of the firing lever 180 underneath the tab 272 of the striker 112. With the firing lever 180 located in its rest position, the resilient finger exerts a lateral return force on the front portion 186 of the firing lever 180 which is sufficient to counterbalance the lateral bias force of the torsion spring arm 214 on the rear portion 188 of the firing lever to maintain the front tip 190 in a lateral position aligned with the tab 272 of the striker 112.

The support member 280 has a stop (not shown) formed as an inclined ramp at the front of the base for engaging the front portion 186 of the firing lever 180 in its rest position to locate the front tip 190 of firing lever 180 in a predetermined lateral position relative to the striker 112. The stop engages the front portion 186 of the firing lever 180 in its rest position to limit the lateral movement of the firing lever 180 under the urging of the return spring 204 and to limit the amount of bending of the resilient finger in the rest position of the firing lever 180. The stop enhances the longevity of the molded plastic resilient finger. The base has a raised platform extending laterally between the side walls which is received in an elongated notch 298 (FIG. 2) near the front of the firing lever 180 in its rest position. The front edge of the resilient finger is spaced rearwardly from the platform to provide clearance for movement of the resilient finger.

Referring to FIG. 1, the upper operating lever 160 includes a pair of opposed lugs 302 (one shown) formed on the depending flanges 165 and projecting inwardly therefrom. The lugs 302 receive an upper end of the rear portion 188 of the lower firing lever 180 therebetween and engage opposite sides of the firing lever 180 to guide the movement of the firing lever 180 relative to the operating lever 160 when the actuator mechanism 110 is operated.

Each of the lugs 302 has an elongated rectangular shape. One of the lugs 302 is generally flat and located slightly rearward of the other lug which has a rounded shape. The lugs 302 are formed as lances which are punched inwardly from the metal of the depending flanges 165. The rounded lug 302 is punched inwardly to a lateral depth which is greater than the lateral depth of the flat lug 302. The lug 302 has an inner flat bearing surface and the round lug 302 has an inner rounded bearing surface for engaging the opposite sides of the rear portion 188 of the lower firing lever 180. The bearing surfaces facilitate the pivoting and rocking movement of the firing lever 180. The rounded bearing surface of the round lug 302 provides a line-point contact with one side of the rear portion 188 of the firing lever 180 and permits a rolling action to occur when the firing lever is rocked sideways relative to the pivot pin 182 in one direction. The flat bearing surface of the flat lug 302 contacts the opposite side of the rear portion 188 of the firing lever 180 and functions as a spacer which permits less rolling action to occur when the firing lever 180 is rocked sideways about the pivot pin 182 in the other direction.

When the lower firing lever 180 is rocked sideways to shift its front portion 186 toward the housing section 106, the rear portion 188 of the firing lever 180 engages the rounded lug 302 of the upper operating lever 160. The rounded lug 302 on the operating lever 160 and the arcuate pad 228 (FIG. 4) on the cylindrical boss 184 provide contact points which define an axis about which the lower firing lever 180 is rocked to achieve the shifting of the front portion 186 of the firing lever 180 toward the housing section 106.

When the lower firing lever 180 is rocked sideways to shift its front portion 186 toward the housing section 104, the rear portion 188 of the firing lever 180 engages the flat lug 302 of the upper operating lever 160. The flat lug 302 on the operating lever 160 and the arcuate pad 230 (FIG. 6) on the cylindrical boss 185 provide contact points which define an axis about which the lower firing lever 180 is rocked to achieve the shifting of the front portion 186 of the firing lever 180 toward the housing section 104.

The actuator handle 122 comprises a hollow elongated cover-like element formed as a two-part composite structure including a hollow elongated base member to which an outer cover or shroud is bonded. For example, the base member is made of a hard thermoplastic elastomer such as polypropylene and the outer cover or shroud is made of a softer thermoplastic elastomer, e.g., Vistaflex, a trademark of the Advanced Elastomers Company. The screw receiving stems 168 are cylindrical in shape and depend from the hollow elongated base member. The base member has a pair of support flanges which extend longitudinally from the cylindrical stems 168 and rest on the top wall of the upper operating lever 160.

Figure 11:
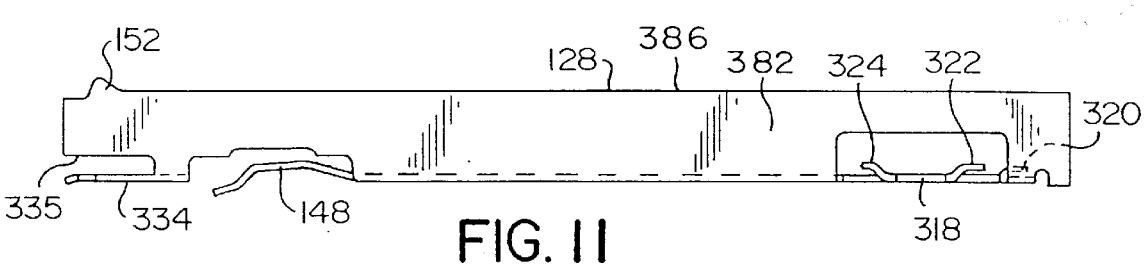
FIG. 11 is a side view of a fastener guide track which forms part of a fastener feed mechanism at the bottom of the device of FIG. 1.
Figure 12:
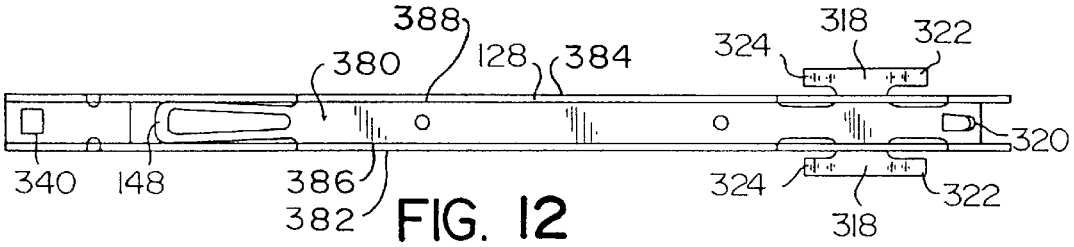
FIG. 12 is a top view showing the fastener guide track of FIG. 11.
Figure 13:
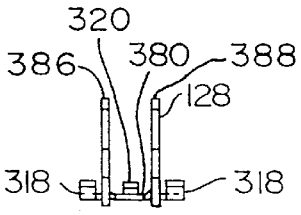
FIG. 13 is a front view showing the fastener guide track of FIG. 11.

Referring to FIGS. 11, 12 and 13, the guide track 128 is an elongated channel-shaped member and includes a pair of side flanges 318 which project outwardly in opposite directions at the lower front portion of the guide track 128. The guide track 128 has a front lug 320 for connection to the tension spring 134 (FIG. 1). Each side flange 318 is bent upwardly at its front and rear ends to provide an offset front tab 322 and an offset rear tab 324. The side flanges 318 are slidably received between a pair of elongated guide rails 326 and 328 (FIGS. 4 and 6) extending along the interior of the side wall 135 of each of the housing sections 104 and 106. A depending stop 330 (FIG. 4) is formed on the upper guide rail 326 of the housing section 104 for engaging the rear tab 324 (FIG. 12) on the corresponding side flange 318 to limit the rearward movement of the guide track 128 when it is pulled backward to load the fasteners 130 into the receiving channel 137 at the bottom of the fastener 100. The front tabs 322 on the side flanges 318 are received in corresponding notches 332 (FIG. 14) formed on opposite sides of the nosepiece 140 when the guide track 128 is pushed into the fastener receiving channel 137 with the lugs 152 inserted into the notches 154.

An arm 334 (FIG. 11) is provided at the lower rear portion of the guide track 128 for attachment to the track pull member 144. A longitudinal slot 335 is formed above the arm 334 on each side of the guide track 128 for receiving a ledge 336 (FIG. 25) extending transversely between the opposite sides of the U-shaped track pull member 144. A lug 338 (FIG. 27) on the underside of the ledge 336 is received in a corresponding opening 340 (FIG. 12) formed on the rear arm 334 of the guide track 128. An upper lip 342 (FIG. 26) on the track pull member 144 overlaps a top rear portion of the guide track 128 to complete the attachment of the track pull member 144 to the guide track 128.

Figure 22:
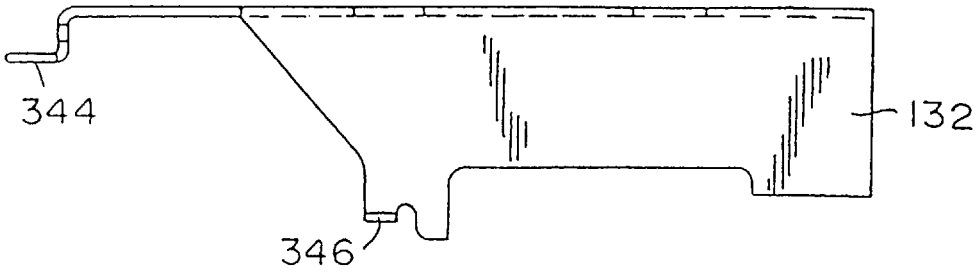
FIG. 22 is a side view of a fastener pusher which forms a part of the fastener feed mechanism.
Figure 23:
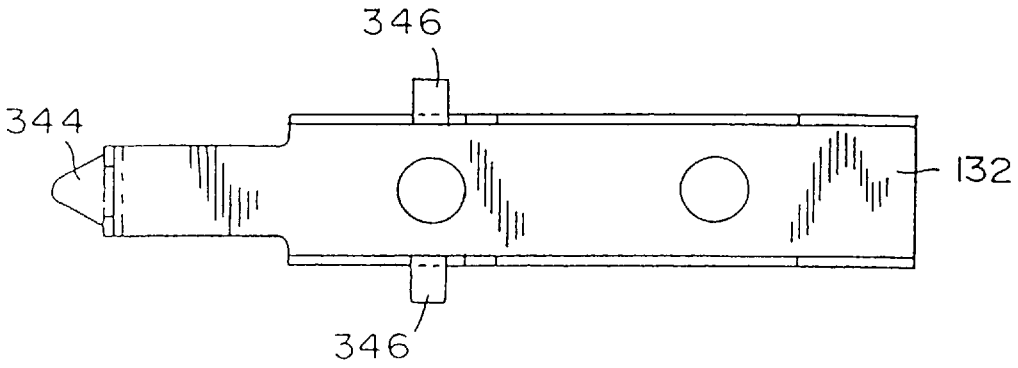
FIG. 23 is a bottom view of the fastener pusher of FIG. 22.
Figure 24:
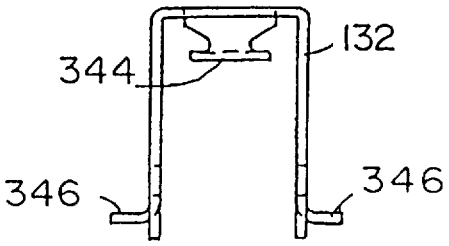
FIG. 24 is an end view of the fastener pusher of FIG. 22.
Figure 25:
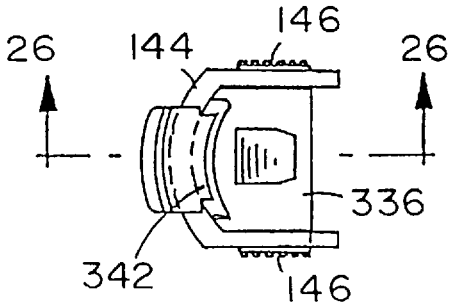
FIG. 25 is a top view of a pull member at the rear of the fastener feed mechanism.
Figure 26:
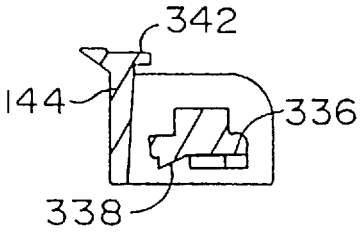
FIG. 26 is a vertical section of the pull member along line 26—26 of FIG. 25.
Figure 27:
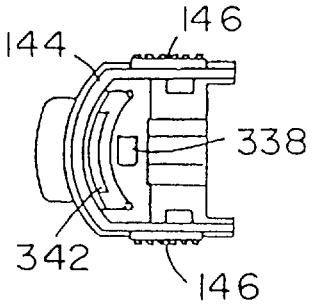
FIG. 27 is a bottom view of the pull member of FIG. 25.

As shown in FIGS. 22, 23 and 24, the staple pusher 132 is channel-shaped in configuration and adapted to slidably rest on the top of the guide track 128. The pusher 132 includes a rear finger 344 for connection to the tension spring 134 (FIG. 1). A pair of side lugs 346 (FIG. 23) which project outwardly from opposite sides of the pusher 132 are engaged by the rear tabs 324 (FIG. 12) on the side flanges 318 of the guide track 128 to limit the forward movement of the pusher 132 relative to the drive track 128 when the last fastener 129 is driven from the stapler 100.

Generally, the device 100 is operated in the following manner. The device 100 is gripped by the hand of an operator with the thumb resting on the handle 122, the index finger extending through the front opening 116 and the remaining fingers extending through the elongated opening 118. The device 100 is positioned with its lower side walls 135 in contact with a surface or workpiece into which one of the fasteners 129 is driven. The device 100 is actuated by depressing the handle 122 to operate the actuator mechanism 110 to reciprocate the striker 112 to drive the frontmost fastener 129 into the adjacent surface or workpiece.

Figures 28, 29, 30, 31:
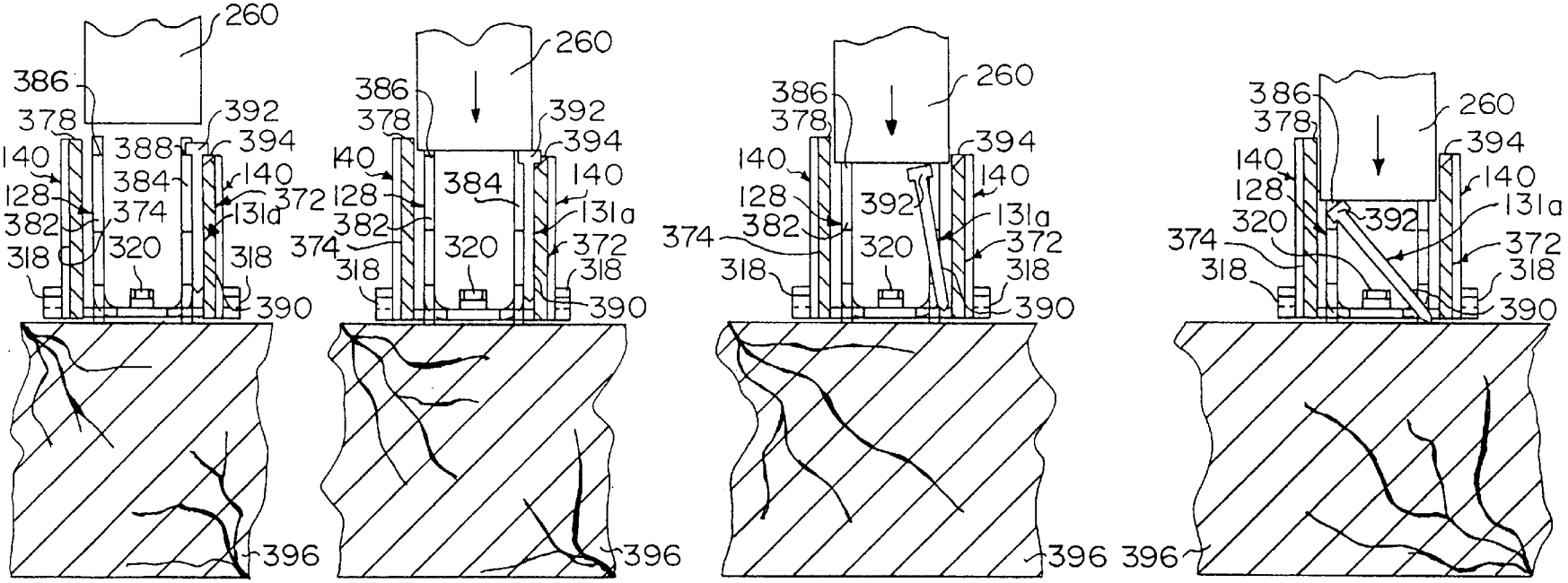
FIG. 28 is a partial sectional view showing a striker blade of FIGS. 8, 9 and 10 in position to drive a nail from a lead position within the nosepiece of FIGS. 14, 15 and 16 into a workpiece.
FIG. 29 is a partial sectional view showing the striker blade of FIG. 28 on a downward stroke to drive the nail.
FIG. 30 is a partial sectional view showing the nail of FIGS. 28 and 29 skewing slightly to the left under the driving action of the striker blade.
FIG. 31 is a partial sectional view showing the nail of FIG. 30 skewed between opposite sides of the nosepiece.
Figures 32, 33, 34, 35:
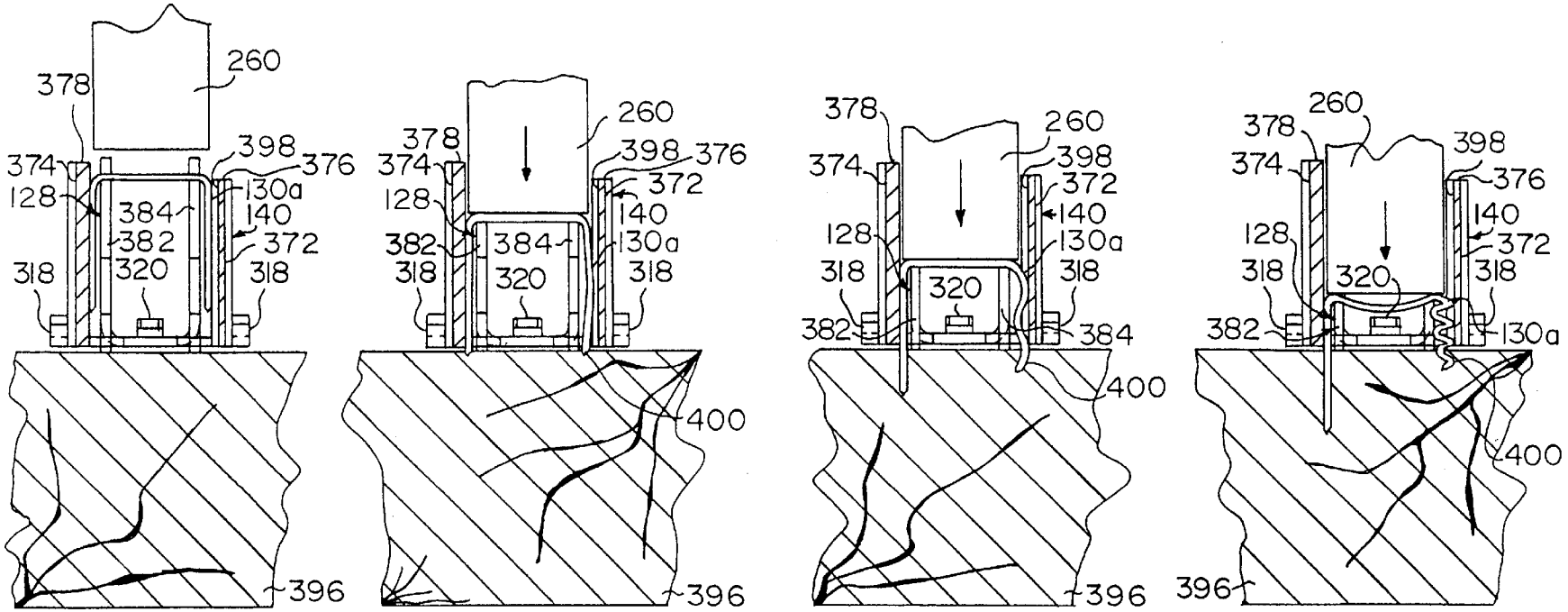
FIG. 32 is a partial sectional view showing a "U" shaped fastener, such as a staple, in a lead position beneath the striker blade of FIGS. 8, 9 and 10 between spaced sidewalls of the nosepiece of FIGS. 14, 15 and 16 as modified in FIGS. 17 and 18.
FIG. 33 is a partial sectional view showing the striker blade of FIG. 32 on a downward stroke to drive the staple from the device.
FIG. 34 is a partial sectional view showing the staple of FIG. 33 partially driven from the device and with one leg of the staple being crimped slightly to the right due to the modification to the nosepiece of FIGS. 17 and 18.
FIG. 35 is a partial section view showing the staple of FIG. 34 being driven further by the striker blade and showing the one leg of the staple being crimped further due to the modification to the nosepiece of FIGS. 17 and 18.

When the handle 122 is depressed by the operator, the upper operating lever 160 pivots downward relative to the housing 102 and the front portion 186 of the firing lever 180 is pivoted upward to raise the striker 112 against the bias of the actuator spring 240 from a "rest" position to a "load" position. With the striker 112 raised to the top of the power stroke in the "load" position (FIG. 2), the front portion 186 of the firing lever 180 is located above the guide rib 232 and the hook-like projection 234 is moved above the ledge 236. The front portion 186 of the firing lever 180 is shifted laterally by the camming action of the front tip 190 against the striker tab 272 to move the front tip 190 to one side of the striker tab 272 and to release the striker 112 for actuation by the actuator spring 240. The striker 112 is driven downward by the actuator spring 240 to the bottom of the power stroke (FIG. 3) to drive the frontmost fastener 129 from the housing 102 into an adjacent surface or workpiece 396 (FIGS. 28 and 32).

When the handle 122 is released by the operator, the front portion 186 of the firing lever 180 is shifted laterally in the opposite direction by the lateral biasing force of the return spring 204 to move the front tip 190 on the opposite side of the striker tab 272. The front portion 186 of the firing lever 180 is pivoted downward about the pivot pin 182 toward its rest position by the return spring 204 and the operating lever 160 is pivoted back to an upwardly inclined position. In addition, the front portion 186 of the firing lever 180 is shifted laterally to its rest position by the resilient finger 292 of the support member 280 to locate the front tip 190 of the firing lever 180 underneath the striker tab 272 for the next power stroke of the device 100.

With the firing lever 180 in the rest position, its front tip 190 is located underneath the tab 272 on the striker 112. The front portion 186 of the firing lever 180 is urged laterally into engagement with the resilient finger of the support member 280 by the lateral biasing action of the return spring 204. The resilient finger exerts a force on the front portion 186 of the firing lever 180 to counterbalance the action of the return spring 204 on the rear portion 188 of the firing lever 180 to locate the front tip 190 in the desired position underneath the tab 272 of the striker 112. The stop on the support member 280 limits the bending of the resilient finger in response to the lateral biasing force of the return spring 204 on the firing lever 180 and locates the front tip 190 in a predetermined lateral position relative to the striker tab 272.

When the front portion 186 of the firing lever 180 is pivoted upward by depressing the handle 122, the front tip 190 is moved upward into engagement with the underside of the striker tab 272. The resilient finger remains engaged with the front portion 186 of the firing lever 180 to ensure that the front tip 190 moves upward into engagement with the striker tab 272. After the striker tab 272 is engaged by the front tip 190, the mechanical engagement therebetween resists the lateral biasing action of the return spring 204 and maintains the front tip 190 in engagement with the striker tab 272. Since the upper surface 274 of the front tip 190 is canted at the same angle as the striker tab 272, the tip 190 is urged in a first lateral direction (toward the housing section 106) to one side of the striker tab 272 as the front portion 186 of the firing lever 180 is pivoted upward.

However, because the front portion 186 of the firing lever 180 is engaged with the adjacent face of the guide rib 232 and the hook-like projection 234 is engaged with the adjacent face of the ledge 236, the front tip 190 is maintained in engagement with the striker tab 272. The front tip 190 remains engaged with the striker tab 272 until the front portion 186 of the firing lever 180 is pivoted above the guide rib 232 and the hook-like projection 234 is moved above the ledge 236 at the top of the power stroke.

At the top of the power stroke, with the front portion 186 of the firing lever 180 pivoted above the guide rib 232, the front tip 190 is shifted in the first lateral direction to one side of the tab 272 to release the striker 112 for actuation by the actuator spring 240. When the front tip 190 is disengaged from the underside of the tab 272, the striker 112 is driven rapidly downward by the actuator spring 240 to drive the frontmost fastener 129 from the device housing 100 into the adjacent surface or workpiece. As the striker 122 is driven downward, the striker tab 272 slides along the adjacent side of the front tip 190. The front portion 186 of the firing lever 180 is located above the guide rib 232. Also, the hook 234 on the front portion 186 of the firing lever 180 is shifted laterally into engagement with the ledge 236 on the housing section 106.

After the striker 112 is driven downward by the actuator spring 240, the front portion 186 of the firing lever 180 is shifted in a second or opposite lateral direction (toward the housing section 104) by the lateral biasing action of the return spring 204 when the actuator handle 122 is released. The front tip 190 is shifted to the opposite side of the striker tab 272 for the return movement of the firing lever 180 to its rest position. The front portion 186 of the firing lever 180 is displaced away from the guide rib 232. Also, the hook 234 on the front portion 186 of the firing lever 180 is moved away from the ledge 236 on the housing section 106.

As the front portion 186 of the firing lever 180 pivots downward toward its rest position, the resilient finger of the support member 280 engages the front portion 186 of the firing lever 180 and shifts the front tip 190 in the first lateral direction relative to the striker tab 272. Initially, the resilient finger of the support member 280 urges the front tip 190 of the firing lever 180 laterally against the adjacent side of the striker tab 272. The front tip 190 slides downward along the adjacent side of the striker tab 272 until the front tip 190 is moved to a position under the striker tab 272. Then the resilient finger shifts the front portion 186 of the firing lever 180 in the first lateral direction into its rest position to locate the front tip 190 underneath the striker tab 272.

When the firing lever 180 is returned to its rest position, the front tip 190 is located in a lateral position underneath the striker tab 272 where the lateral biasing action of the return spring 204 on the rear portion 188 of the firing lever 180 is counterbalanced by the action of the resilient finger of the support member 280 against the front portion 186 of the firing lever 180. The front tip 190 is accurately located underneath the striker tab 272 for the next power stroke of the device 100. The stop of the support member 280 limits the lateral movement of the front portion 186 of the firing lever 180 by the lateral biasing action of the return spring 204 and limits the amount of bending of the resilient finger of the support member in the rest position of the firing lever 180.

Figure 14:
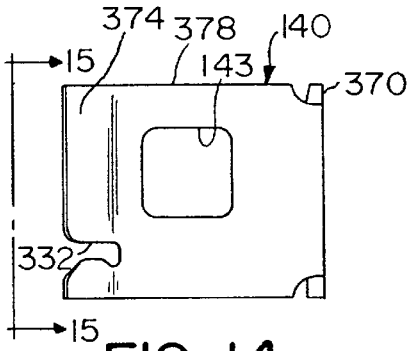
FIG. 14 is a side view of a nosepiece at the front of the fastener feed mechanism.
Figure 15:
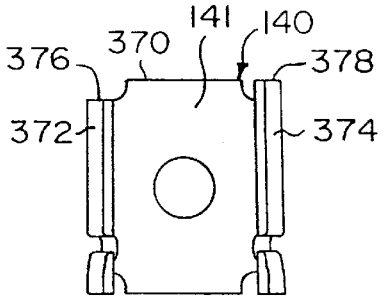
FIG. 15 is an end view of the nosepiece taken along line 15—15 of FIG. 14.
Figure 16:
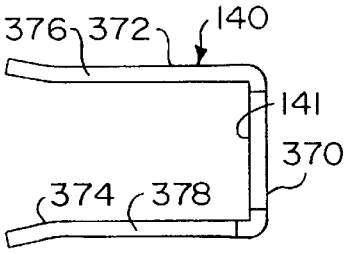
FIG. 16 is a top view of the nosepiece of FIG. 14.
Figure 21:
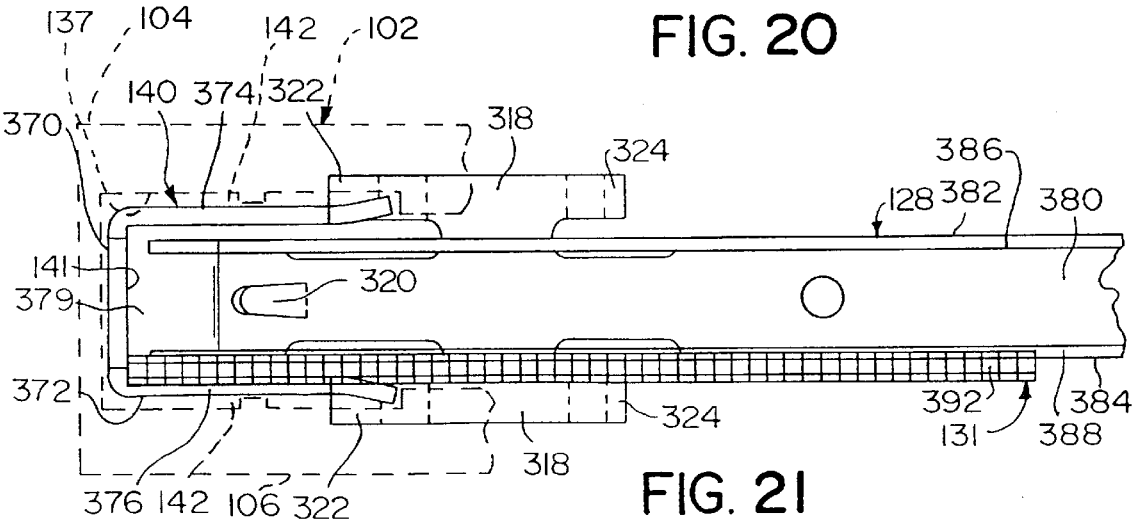
FIG. 21 is a plan view of the fastener feed mechanism of FIGS. 11, 12 and 13 showing fasteners, such as nails, located in the mechanism.

Referring to FIGS. 14, 15 and 16, and as noted above, the nosepiece 140 includes the center wall 370 integrally joined to the spaced sidewalls 372 and 374 in the "U" shaped configuration as shown in FIG. 16. The sidewalls 372 and 374 are formed with ledges 376 and 378, respectively, on upper surfaces thereof. Center wall 370 is formed with the inner surface 141. As shown in FIG. 21, the nosepiece 140 is assembled within housing 102 and the forward end of guide track 128 is located symmetrically within the space between the sidewalls 372 and 374 of the nosepiece. The forward end of the track 128, is spaced from the inner surface 141 of the nosepiece 140 to define the fastener discharge space 379 (FIG. 21). The guide track 128 is formed in a channel configuration having a base 380 and a pair of spaced sidewalls 382 and 384 extending in parallel fashion from opposite sides of the base. Sidewalls 382 and 384 are formed with ledges 386 and 388, respectively.

When the fastening device 100 is to be used to drive the staples 130 from the device, a supply of the staples is loaded on guide track 128. In this use, the "U" shape of the staples 130 is inverted and the linking or center leg of each of the staples straddles the sidewalls 382 and 384 of the track 128 and the side legs of the staples extend along the outer surfaces of the sidewalls 382 and 384. As the staples 130 are advanced toward the discharge space 379, the side legs of the staples enter and pass through a small space defined by the pair of spaced sidewalls 372 and 374 of the nosepiece 140 and the sidewalls 384 and 382, respectively, of the track 128. The lead staple 130*a* is advanced into the discharge space 379 in position to be driven from the device 100 by the striker 260 (FIG. 32).

While fasteners 129 such as the staples 130 can be driven from the device 100 with the structure described heretofore, it is desirable that the same facility be sufficiently versatile to also drive fasteners of a different configuration, such as the nails 131.

As shown in FIG. 28, nail 131 is formed in a "T" shaped configuration having a stem 390 and a head 392 with portions which overhang from opposite sides of the stem. Referring again to FIG. 21, when the device 100 is to be used to drive nails 131 therefrom and, for example, into a workpiece 396, a supply of the nails is located on the guide track 128 in such a manner that one side of the head 392 of each nail overhangs and rests on the ledge 388. The lead nail 131*a* is located in the discharge space 379 awaiting the release of the striker 260 (FIG. 28) to drive the lead nail from the fastening device 100. In this position, the lead nail 131*a* has been advanced to the inner surface 141 of the center wall 370 of the nosepiece 140. The twelve or so nails 131 which immediately trail the lead nail 131*a* are situated so that the other side of the heads 392 of the trailing nails are resting on the ledge 376 of the nosepiece 140.

As shown in FIG. 28, the lead nail 131*a* is positioned in alignment with the striker 260 in preparation for driving the nail from the device 100 as noted above. Even though the lead nail 131*a* has been moved into the discharge space 379, one side of the nail head 392 continues to overhang the sidewall 372 of the nosepiece 140. If the nail 131*a* is driven straight from the position illustrated in FIG. 28, the overhanging portion of the head 392 will undesirably engage the sidewall 372 resulting in damage to the nail or the sidewall, or both. Some accommodation must be made to allow the nail 131*a* to be driven from the device 100 in a desired alignment.

As shown clearly in FIG. 31, a bevelled surface 394 was formed in the ledge 376 in an effort to urge the head 392 of the nail 131*a* slightly to the inboard side of sidewall 372 as the nail was being driven in an outbound direction. Referring to FIG. 29, the striker 260 starts to drive the nail 131*a* from the device 100 whereby the overhanging portion of the head 392 shifts slightly due to the presence of the bevelled surface 394. As the striker 260 continues its power or driving stroke as shown in FIG. 30, the head 392 has exited the bevelled surface 394. However, the nail 131*a* has been set on a course whereby the head 392 is being moved toward the opposite side of the discharge space 379. As shown in FIG. 31, the nail 131*a* is now skewed across the discharge space 379 and is destined undesirably to be deformed and not driven into the workpiece 396 in the desired alignment, if at all.

Figure 17:
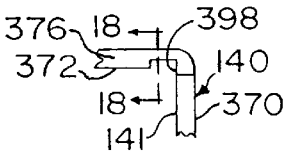
FIG. 17 is a partial top view of the nosepiece of FIG. 16 showing a first modification thereto.
Figure 18:
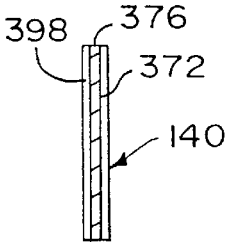
FIG. 18 is a sectional view taken along line 18—18 of FIG. 17 showing certain aspects of the first modification of the nosepiece of FIG. 17.

In an effort to prevent the nail 131*a* from skewing in the discharge space 379 as shown in FIG. 31, the nosepiece 140 was modified as shown in FIGS. 17 and 18. In particular, a groove 398 was formed in the inside surface of the sidewall 372 of the nosepiece 140 adjacent the juncture of the sidewall with the center wall 370 of the nosepiece and in alignment with the discharge space 379. The groove 398 extends from the ledge 376 of the nosepiece 140 to the opposite edge of the sidewall 372. With this structure, the head 392 of the nail 131*a* is clear of the sidewall 372 when the nail is advanced into the discharge space 379. When the striker 260 drives the nail 131*a* from the discharge space 379, the portion of the head 392 aligned with the groove 398 will allow the nail to be driven in the desired alignment from the device 100 and, if desired, into the workpiece 396.

Referring to FIG. 32, the lead staple 130*a* is positioned in the discharge space 379 (FIG. 21) of the device 100 which includes the groove 398. As the staple 130*a* is first moved by the striker 260 as shown in FIG. 33, leg 400 of the staple adjacent the groove 398 begins to bow into the groove because the adjacent supporting portion of the sidewall 372 has been removed to form the groove. Referring to FIG. 34, as the striker drives the staple 130*a* further from the device 100, the staple leg 400 is crimped somewhat and is not exiting the device or entering the workpiece 396 as intended. Eventually, as shown in FIG. 35, the leg 400 of the staple 130*a* is crimped drastically and, obviously, unacceptably.

Figure 19:
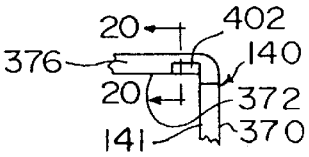
FIG. 19 is a partial top view of the nosepiece of FIG. 16 showing a second modification thereto in lieu of the first modification of FIG. 17 in accordance with certain principles of the invention.
Figure 20:
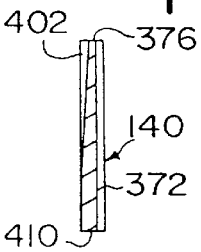
FIG. 20 is a sectional view taken along line 20—20 of FIG. 19 showing certain aspects of the second modification of the nosepiece of FIG. 16 in accordance with certain principles of the invention.

In a further effort to develop a versatile fastening device, nosepiece 140 as shown in FIG. 16, was modified as shown in FIGS. 19 and 20 by forming a long steep slope 402 in the inner surface of the sidewall 372 adjacent its juncture with the center wall 370. The slope 402 begins in ledge 376 and extends toward the opposite edge of the sidewall and tapers outwardly from top to bottom thereof as shown in FIG. 20. In the preferred embodiment of the invention, the slope 402 begins in the ledge 376 of the nosepiece 140 with a width of 1.5 millimeters and an initial depth of 0.7 millimeter from the inner surface of sidewall 372 and extends downward along the inner surface for a distance of 14.3 millimeters, or 2.5 millimeters from an edge 410 of the sidewall 372 opposite the ledge 376. The distance of 14.3 millimeters represents about 85% of the total dimension of 16.8 millimeters between the ledge 376 and the edge 410 of the sidewall 372. The angle of the taper of the slope 402 in the preferred embodiment is three degrees as measured with respect the plane of the inner surface of the sidewall 372. The slope 402 can be formed with other dimensions and taper angles without departing from the spirit and scope of the invention.

Figure 38:
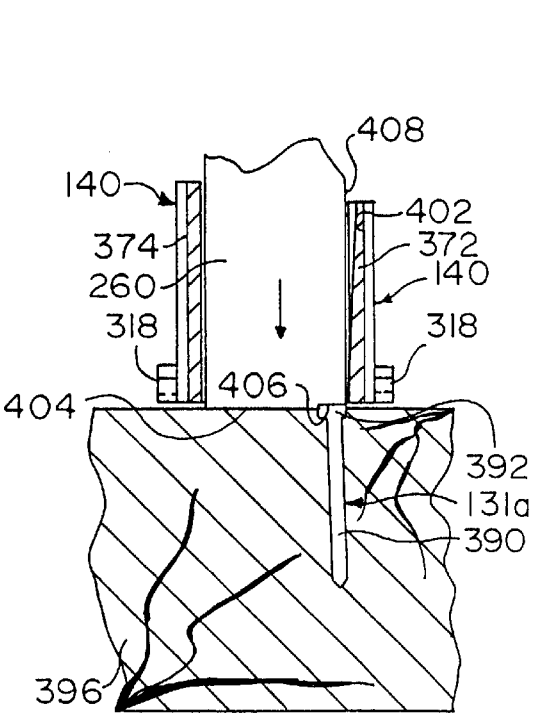
FIG. 38 is a partial sectional view showing the striker of FIG. 36 completing the downward stroke with the nail having been successfully driven from the device in accordance with certain principles of the invention.
Figure 37:
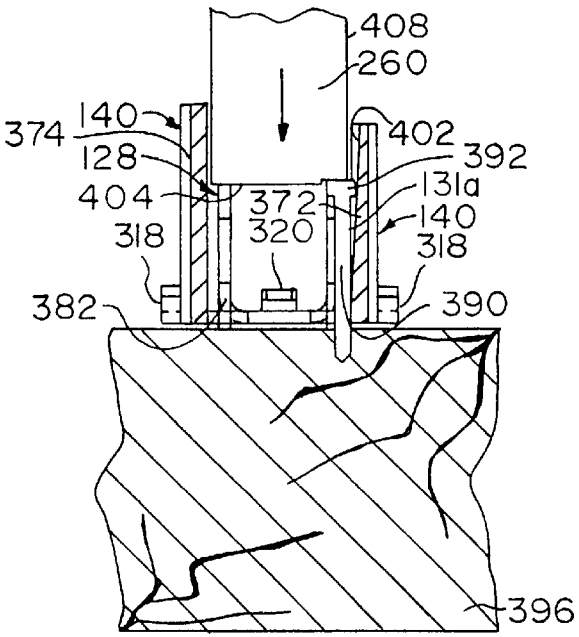
FIG. 37 is a partial sectional view showing the striker blade of FIG. 36 in a downward stroke to partially drive the nail from the device in a desirable alignment in accordance with certain principles of the invention.
Figure 36:
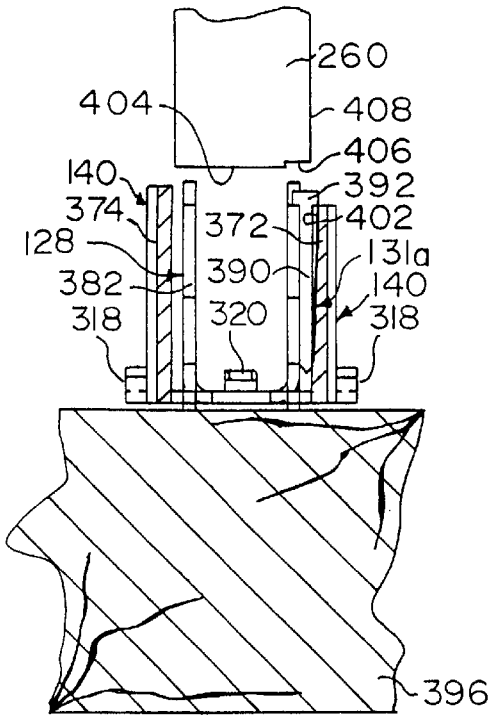
FIG. 36 is a partial sectional view showing a nail in a lead position within the nosepiece of FIGS. 14, 15 and 16 as modified in FIGS. 19 and 20 in accordance with certain principles of the invention and beneath the striker blade the bottom of which has been modified in accordance with certain principles of the invention.

As shown in FIG. 36, the lead nail 131*a* is located in the discharge space 379 and adjacent the slope 402. As the nail 131*a* is initially urged through the discharge space 379 as shown in FIG. 37, the taper of the slope allows the head 392 of the nail 131*a* to ease away from the sidewall 372 of the nosepiece 140 in gradual fashion. In this manner, the nail 131*a* is driven from the device 100, and into the workpiece 396, in a desirable alignment as shown in FIG. 38.

Figures 39, 40, 41, 42:
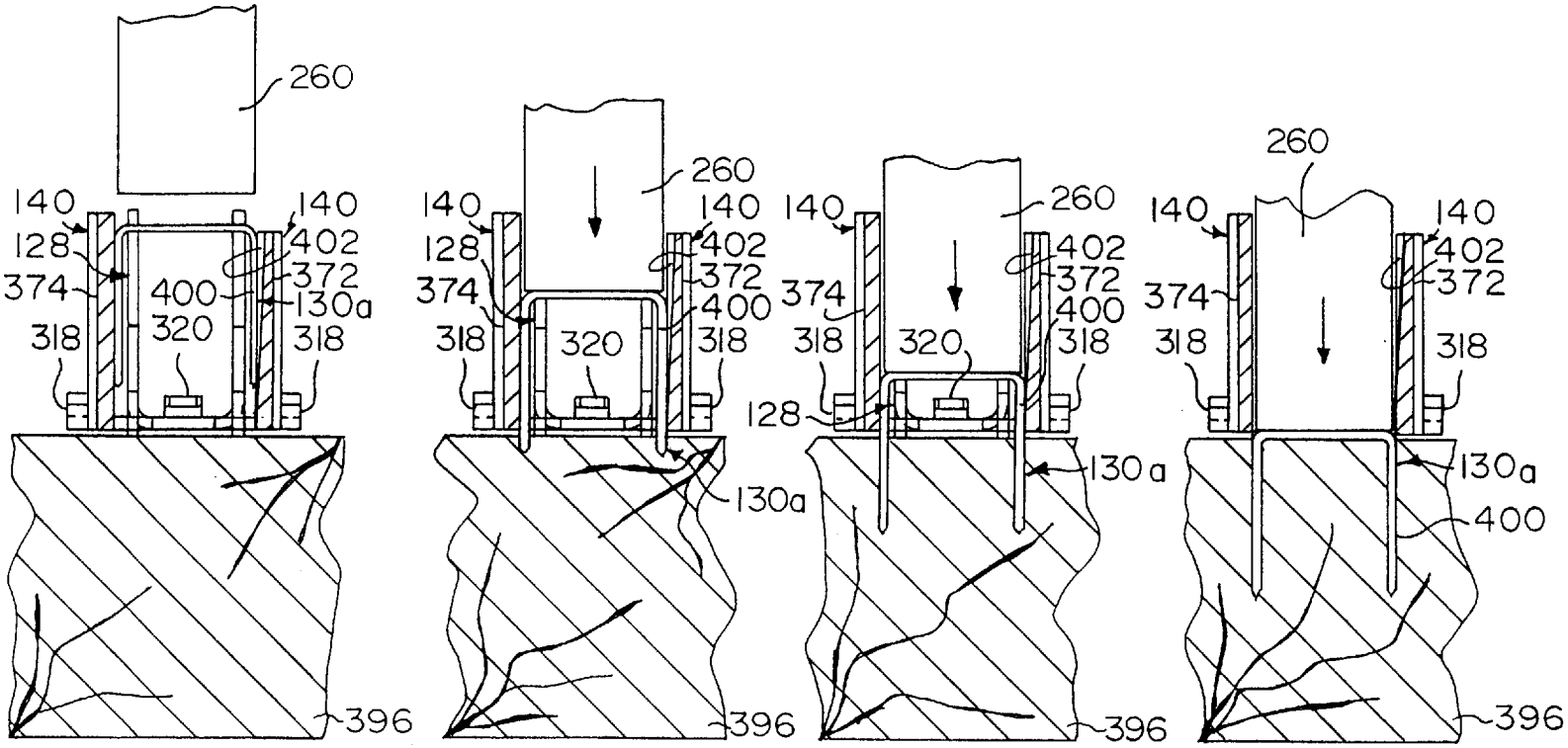
FIG. 39 is a partial sectional view showing the striker blade above a staple within the nosepiece of FIGS. 14, 15 and 16 as modified in FIGS. 19 and 20 in accordance with certain principles of the invention.
FIGS. 40 and 41 are partial sectional views showing the striker blade of FIG. 39 in various stages of a downward stroke to drive the staple from the device in accordance with certain principles of the invention.
FIG. 42 is a partial sectional view showing the striker blade of FIG. 40 having completed the downward stroke to drive the staple in a desired direction in accordance with certain principles of the invention.

Referring to FIG. 39, the lead staple 130*a* is located in the discharge space 379 (FIG. 21) with the staple leg 400 being adjacent to the slope 402 formed in the sidewall 372 of the nosepiece 140. As the staple 130*a* is driven from the device 100 as shown in FIG. 40, the slope 402 is sufficiently steep and of slight depth to the extent that the leg 400 is supported sufficiently to prevent crimping of the leg. As further viewed in FIGS. 41 and 42, the staple 130*a* continues to be supported as the leg 400 is nearly, and finally, moved out of the device 100 in a desired alignment and, if desired, into the workpiece 396.

Thus, with the formation of the slope 402 in the sidewall 372 of the nosepiece 140, the fastening device 100 is capable of receiving and driving at least two types of fasteners 129 such as, for example, the staples 130 and the nails 131 having different configurations. This is the preferred embodiment of the invention and provides a versatile device for driving fasteners.

While the formation of the slope 402 in the preferred embodiment allows the use of the single fastening device 100 to drive staples 130 and nails 131 from the same device without the need for any adjustments thereto, the device can be modified in another manner to drive the staples and the nails from the same device. In particular, and referring to FIGS. 36, 37, 38 and 43, a lower bottom edge 404 of the striker 260 is formed with a notch 406 extending inward from a side edge 408 of the striker. The notched striker 260 can be used with the unmodified nosepiece 140 as shown in FIGS. 14, 15 and 16, that is, without the formation of the groove 402 in the nosepiece. In this embodiment of the invention, the notch 406 is 0.2 millimeter in depth and extends inward from side edge 408 by a distance of 2.5 millimeters. The notch 406 could be formed with other dimensions without departing from the spirit and scope of the invention.

When using the device 100 with the striker 260 the notch 406, and not including slope 402, the striker is located above the lead nail 131*a* such that the notch is positioned above the head 392 of the nail as shown in FIG. 36. When the striker 260 is released, the notch 406 forms a nest which is located about the head 392 as shown in FIG. 37 to capture the head. This prevents the head 392 from moving substantially laterally within the discharge space 379 as the nail is being driven through the discharge space and, ultimately, from the device 100 and, if desired, into the workpiece 396. The capture of the head 392 within the nest of the notch 406 continues as the nail is fully driven from the device 100 as illustrated in FIG. 38. It is noted that the notch 406 extends a distance from the edge 408 of the striker 260 that is slightly greater than the side-to-side dimension of the cross arm of the "T" shape of the nail 131*a*. This allows the nail head 392, and the nail 131*a*, to move slightly to the left, or laterally, as viewed in FIGS. 37 and 38 when the nail is being urged slightly to the left by the engagement of the side of the head with the inner surface of the sidewall 372.

Since only a small portion of the bottom edge 404 of the striker 260 has been modified to form the notch 406, a sufficient portion of the bottom edge remains to drive the staples 130 from the device 100 when the staples are being driven therefrom rather than the nails 131. Again, this provides a versatile fastening device 100 for driving fasteners 129 of at least two different configurations. It is noted that in this embodiment, bevelled surface 394 (FIG. 28) would be formed in the ledge 376 to move to the left as viewed in FIG. 37 and into the notch 406.

In still another embodiment, the striker 260 with the notch 406 can be used in combination with the nosepiece 140 having the groove 402 formed therein. The staples 130 and the nails 131 would react in the same manner as described above with respect to the individual operation of the striker 260 with the notch 406 and the nosepiece 140 with the groove 402. In this embodiment, the presence of the groove 402 allows a gradual lateral shifting of the nail 131*a* as it is being moved through the discharge space 379 whereby the nail head 392 gradually moves laterally to the extent it is allowed to move by virtue of the extended distance of the notch 406. This embodiment also provides a fastening device 100 which is versatile and capable of driving fasteners 129 of at least two configurations.

In general, the above-identified embodiments are not to be construed as limiting the breadth of the present invention. Modifications, and other alternative constructions, will be apparent which are within the spirit and scope of the invention as defined in the appended claims.

What is claimed is:

1. A fastening device, which comprises:

a housing;

a fastener guide mounted on the housing for supporting selectively fasteners of either of at least two distinctly different configurations in position to be driven from the device, the fastener guide having structure which guides the fasteners of the at least two configurations from the housing in substantially their pre-driven configurations; wherein the fastener guide further includes a surface adjacent at least a portion of the fastener being guided, the surface forming a surface of a wall, and a groove formed in the surface which guides the portion of the fastener as the fastener is being driven from the housing;

the wall is formed with a ledge at one end thereof and an edge at the opposite end thereof with the surface extending therebetween;

one end of the groove is formed in the ledge and extends along the surface toward the edge, wherein the groove is formed with a base which is tapered toward the surface from the ledge as the groove extends toward the edge to a juncture of the base with the surface; and further comprising a striker mounted on the housing for engaging and driving the fasteners from the device;

a spring biasingly coupled between the housing and the striker;

a lever assembly mounted on the housing and removably coupled to the striker for moving the striker to a "load" position against the biasing action of the spring; and a structure located in the housing for decoupling the lever assembly from the striker when the striker has been moved to the "load" position whereby the striker moves toward and drives the fastener from the housing.

2. The fastening device as set forth in claim 1, wherein the structure of the fastener guide includes structure which will guide a "U" shaped staple or a "T" shaped nail.

3. The fastening device as set forth in claim 1, which further comprises a fastener discharge space and wherein the structure of the fastener guide comprises a surface adjacent a portion of the discharge space which is structured to allow movement of the fastener laterally of the direction of movement of the fastener resulting from the driving of the fastener by the striker.

4. The fastening device as set forth in claim 3, wherein the surface is a groove which allows the lateral movement of the fastener as the fastener is being driven from the housing by the striker.

5. The fastening device as set forth in claim 4, wherein the groove is formed with structure to urge into the discharge space any portions of the fastener which are located in the groove as the fastener is being driven through the discharge space and from the housing.

6. The fastening device as set forth in claim 5, wherein the structure of the groove is a tapered surface which is sloped in a direction to engage any portions of the fastener located in the groove and urge those portions into the discharge space as the fastener is driven through the discharge space.

7. A fastening device, which comprises:

a housing;

a fastener guide mounted on the housing for supporting selectively fasteners of either of at least two distinctly different configurations in position to be driven from the device, the fastener guide having structure which guides the fasteners of the at least two configurations from the housing in substantially their pre-driven configurations; wherein the fastener guide further includes a surface adjacent at least a portion of the fastener being guided, the surface forming a surface of a wall, and a groove formed in the surface which guides the portion of the fastener as the fastener is being driven from the housing;

the wall is formed with a ledge at one end thereof and an edge at the opposite end thereof with the surface extending therebetween;

one end of the groove is formed in the ledge and extends along the surface toward the edge, wherein the groove is formed with a base which is tapered toward the surface from the ledge as the groove extends toward the edge to a juncture of the base with the surface; and further comprising a striker mounted on the housing for engaging and driving the fasteners from the device;

a spring biasingly coupled between the housing and the striker;

a lever assembly mounted on the housing and removably coupled to the striker for moving the striker to a "load" position against the biasing action of the spring;

a structure located in the housing for decoupling the lever assembly from the striker when the striker has been moved to the "load" position whereby the striker moves toward and drives the fastener from the housing;

the striker is formed with a first structure which engages and allows slight lateral movement of the fasteners of one of the two different configurations as the fasteners are being driven from the housing by the striker; and the striker is formed with a second structure which engages and drives the fasteners of the other of the two different configurations from the housing.

8. The fastening device as set forth in claim 7, wherein the structure of the fastener guide includes structure which will guide a "U" shaped staple or a "T" shaped nail.

9. The fastening device as set forth in claim 7, which further comprises a fastener discharge space and wherein the structure of the fastener guide comprises a surface adjacent a portion of the discharge space which is structured to allow movement of the fastener laterally of the direction of movement of the fastener resulting from the driving of the fastener by the striker.

10. The fastening device as set forth in claim 9, wherein the surface is a groove which allows the lateral movement of the fastener as the fastener is being driven from the housing by the striker.

11. The fastening device as set forth in claim 10, wherein the groove is formed with structure to urge into the discharge space any portions of the fastener which are located in the groove as the fastener is being driven through the discharge space and from the housing.

12. The fastening device as set forth in claim 11, wherein the structure of the groove is a tapered surface which is sloped in a direction to engage any portions of the fastener located in the groove and urge those portions into the discharge space as the fastener is driven through the discharge space.

13. The fastening device as set forth in claim 7, wherein the striker is formed with a surface for engaging and driving the fasteners from the housing, and the first structure of the striker is a nest formed in the surface of the striker for positioning about a selected portion of the fastener of the one of the two configurations as the fasteners are being driven from the housing.

14. The fastening device as set forth in claim 7, wherein the striker is formed with a surface for engaging and driving the fasteners from the housing, and the first structure of the striker is a notch formed in the surface of the striker which is positioned about a selected portion of the fastener of the one of the two configurations as the fasteners are being driven from the housing.

15. The fastening device as set forth in claim 14, wherein the notch is formed in one end of the surface with a base and one sidewall, a side opposite the sidewall being open.

16. The fastening device as set forth in claim 14, wherein the notch is dimensioned to allow movement of the selected portion fasteners of the one of the two configurations laterally within the notch and laterally of the direction of the driven movement of the fasteners from the housing by the striker.

* * * * *

UNITED STATES PATENT AND TRADEMARK OFFICE

CERTIFICATE OF CORRECTION

PATENT NO. : 5,816,470

DATED : Oct. 6, 1998

INVENTOR(S) : Plato et al.

It is certified that error appears in the above-identified patent and that said Letters Patent is hereby corrected as shown below:

Column 7, line 2, after "slidably-" should read --slidably--

Column 8, line 55, delete "241".

Column 8, line 59, "for-actuating" should read --for actuating--.

Signed and Sealed this

Twenty-seventh Day of July, 1999

*Attest:*

Q. TODD DICKINSON

*Attesting Officer*

*Acting Commissioner of Patents and Trademarks*